US005803097A

United States Patent [19]

Gueret

[11] Patent Number: 5,803,097

[45] Date of Patent: Sep. 8, 1998

[54] SINGLE-DOSE COSMETIC ELEMENT

[75] Inventor: Jean-Louis Gueret, Paris, France

[73] Assignee: L'Oreal, Paris, France

[21] Appl. No.: 513,591

[22] Filed: Aug. 10, 1995

[30] Foreign Application Priority Data

Aug. 30, 1994 [FR] France ..... 94-10429

[51] Int. Cl.[6] ..... A45D 40/24

[52] U.S. Cl. ..... 132/318; 132/294

[58] Field of Search ..... 132/293, 294, 132/314, 317, 320, 318; 206/229, 581, 210, 385, 823; 401/98, 99, 88

[56] References Cited

U.S. PATENT DOCUMENTS

| | | | |
|---|---|---|---|
| 3,397,027 | 8/1968 | Harrison | 401/98 |
| 4,617,948 | 10/1986 | Gueret | 132/320 |
| 4,711,354 | 12/1987 | Bennett | 132/318 |
| 4,794,936 | 1/1989 | Zango | 132/320 |
| 5,031,647 | 7/1991 | Seidler | 132/320 |
| 5,107,984 | 4/1992 | Welschoff | 206/581 |
| 5,180,240 | 1/1993 | Gueret | 401/88 |

FOREIGN PATENT DOCUMENTS

| | | | |
|---|---|---|---|
| 0 171 983 | 2/1986 | European Pat. Off. . | |
| 0 238 208 | 9/1987 | European Pat. Off. . | |
| 0 315 937 | 5/1989 | European Pat. Off. . | |
| 0 648 333 | 12/1990 | France . | |
| 522202 | 3/1955 | Italy | 401/98 |
| 91/08692 | 6/1991 | WIPO . | |

*Primary Examiner*—Todd E. Manahan
*Attorney, Agent, or Firm*—Young & Thompson

[57] ABSTRACT

An element for the packaging and presentation of at least one pasty product comprises an applicator equipped with a member for gripping and with a device for holding the product, a chamber equipped with a housing communicating with the outside via a passage, and a sealing device situated in the passage for providing sealing between the housing and the outside. The applicator is housed in the chamber so that the member for gripping can slide in the passage, and so that the holding device embedded in the product extends into the housing. A make-up kit may consist of several such elements.

19 Claims, 2 Drawing Sheets

SINGLE-DOSE COSMETIC ELEMENT

FIELD OF THE INVENTION

The present invention relates to an element for the packaging and presentation of at least one product of pasty to solid consistency. This product may be a composition for the lips, for example a lipstick, or an eyeshadow, or alternatively a paste for protecting the lips from high-dose ultraviolet radiation.

The element according to the invention is generally used for just one application and is thrown away after use, which is advantageous from a hygiene point of view. Thus, it may serve as a sample in cosmetics outlets or beauty salons. Owing to the possibility of shaping it into a flat shape, it may also serve as an advertising medium which can be included, for example, in women's magazines.

BACKGROUND OF THE INVENTION

Document FR-A-2,535,588 makes known a make-up device for the lips, presented in the form of a book of matches, in which each match is a make-up stick, one end of which carries a dose of lipstick. Such a make-up booklet is of flat shape and can therefore easily be kept in the pocket of a garment or in a handbag. This booklet does, however, have the drawback of not being sufficiently rigid to withstand transportation, for example in a handbag, which may lead to the dose of lipstick at the end of its stick becoming damaged. Furthermore, the dose located at the end of the stick is relatively small, which does not allow correct making-up of the lips, using just one make-up stick. In addition, the booklet is not very practical to open and close, and the detachment of a make-up stick requires a certain degree of dexterity. Another drawback lies in the fact that the lipstick is not protected from the oxygen in the air or from microorganisms.

Moreover, described in the document FR-A-2,679,879 in the name of the Applicant Company is an applicator kit comprising an applicator and a support having a hollow part in the shape of the applicator. With one end of the hollow part being filled with a powdery or pasty product, the applicator is pressed is deposited in the hollow part so that it can become impregnated with the deposited product. This element is advantageous from the economical point of view but is not appropriate for all types of product: in the case where the product is a lipstick composition which has been deposited by pouring in the hot state, it is observed, when the applicator is removed after the composition has cooled, that the product has a rough and unattractive surface, and that some of the composition remains stuck in the hollow part.

SUMMARY OF THE INVENTION

The object of the present invention is to avoid the above drawbacks by further simplifying the manufacture of a make-up element of this type.

In particular, the invention targets a single-dose make-up element which protects the product during the storage period, and which is easy to use while exhibiting an attractive appearance.

Thus, the present invention relates to an element for the packaging and presentation of at least one pasty product, comprising: an applicator equipped with a member for gripping and with a means for holding the product; a chamber equipped with a housing communicating with the outside via a passage, the applicator being housed in the chamber so that the member for gripping can slide in the passage, and so that the holding means embedded in the product extends into the housing; a sealing means situated in the passage for providing sealing between the housing and the outside.

"Pasty product" is intended to mean a more or less solid product which can be slaked and which can be poured in the hot state such as, for example, a lipstick composition, or which can be poured in the cold state like a plaster-based composition, such as an eyeshadow composition. In general, a lipstick composition is semi-solid at room temperature and can be liquefied under the influence of heat.

According to the invention, the chamber of this element further comprises an orifice linking the housing with the outside for filling the housing with product. Advantageously, this filling is carried out by pouring the liquefied product in the hot or cold state into the housing, where it sets. Thus, the housing serves as a mould for the product. The housing is advantageously surface-treated by an agent facilitating the release of the applicator from the mould after the product has solidified. This agent facilitating the release from the mould may be chosen from among silicones, perfluorohydrocarbons, Teflon® (polytetrafluoroethylene), talc or molybdenum disulphide. Other agents may be employed insofar as they decrease the adhesion of the product to the walls of the housing. According to another possibility, the housing may equally well be equipped with an attached part acting as a mould, produced, for example, from polyacetal, polyethylene, polypropylene, Teflon® (polytetrafluoroethylene), silicone rubber or any other material capable of decreasing the adhesion of the product to the walls of the housing.

To ensure that the product stays on the applicator, the latter is advantageously equipped with a holding means, made in the form of a loop, hook, adaptor piece, with a rough surface, for example flocking or an open-cell foam or any other appropriate means. For preference, the holding means is in the form of a tongue with a rounded free end, this tongue having an orifice so that this end is in the shape of a loop. The tongue has a spatial size less than that of the housing. According to an advantageous aspect of the invention, the applicator may have a longitudinal vent situated on its axis, placing the housing in communication with the ambient air. This duct allows the air contained in the housing to be driven out upon pouring of the product.

After having filled the housing with product, the orifice linking the housing with the outside may be covered by a film cover, for example by a label indicating the colour of the product, in the case of a lipstick. A transparent label allowing the lipstick to show through may equally be used. Advantageously, the label is a self-adhesive label.

The sealing means provided between the housing and the outside is preferably arranged in a zone as close as possible to the transition zone between the housing and the passage. Thus, the sealing means may consist of at least one bead or collar integral with the member for gripping of the applicator. Advantageously, the applicator is made of a relatively flexible elastomeric or thermoplastic material, for example polyethylene elastomer, polyester, block polyetheramide, polyurethane, nitrile or silicone, which makes it possible to have use of a collar with the capability for given elastic deformation, this collar being able to press in a sealed fashion against the wall of the passage, while remaining capable of moving therein. In order to produce this applicator it is equally possible to select a relatively hard material such as polyethylene, polypropylene or polystyrene; in this case, the chamber is advantageously made of a material with given flexibility.

According to another possibility, this sealing means may be produced on the wall of the passage, for example in the form of a rib in sealed contact with the member for gripping.

The element may be produced in a size which is not very bulky, of flat shape, for example. This makes it possible to use it as an advertising medium which can be included in a women's magazine.

In cosmetics outlets or beauty salons, this element allows the user to perform a correct "try-out application" in sufficient quantity and under good hygienic conditions, before purchasing a lipstick in the corresponding colour.

Furthermore, the product is protected from oxygen and microorganisms. Furthermore, the manufacture and packaging of these elements are simple to achieve at an advantageous cost.

According to one attractive aspect of the invention, several elements of the kind of those which have just been described may be joined together to form a kit for the packaging and presentation of several pasty products; in this case, means are provided for joining them together.

Also, the chamber of a first element may have at least one face equipped with a section piece, the chamber of a second element having at least one face equipped with a groove of a shape which complements that of the section piece, allowing two, three or more elements to be joined together.

As the applicators located in these elements have a longitudinal axis, it is preferable for the faces of the first and second elements, which are respectively equipped with the section piece and with the groove, to be parallel to this axis.

BRIEF DESCRIPTION OF THE DRAWINGS

A kit consisting of several elements containing make-up products of different colours may be displayed at sales outlets.

The invention consists, apart from the provisions explained hereinabove, in a number of other provisions, which will be dealt with more fully hereinafter, with regard to embodiments described with reference to the appended drawings, which are in no way limiting.

DESCRIPTION OF THE PREFERRED EMBODIMENT

Figure 1:
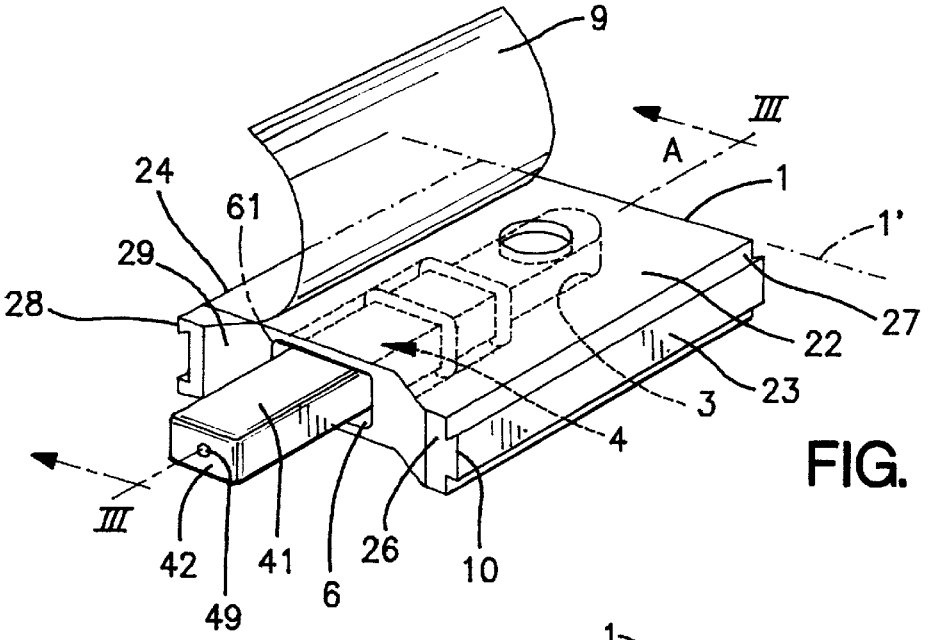
FIG. 1 is a simplified view in elevation of an element in accordance with the invention, with partial cut-away of its upper face.

With reference to the appended FIGS. 1 to 5, the reference 1 has been used to denote an element for the packaging and presentation of a product P of pasty consistency capable of liquefying under the influence of high temperature. This product is, for example, a lipstick composition having a semi-solid consistency at room temperature and able to be poured at a high temperature, for example at 70° C. This product may equally well be a plaster-based product for making-up the cheeks or eyelids which can be poured into the housing in the cold state where it solidifies, after a suitable setting time.

The element 1 comprises a chamber 2 in the shape of a flattened right-angled parallelepiped equipped with two long faces 21, 22 which are parallel and joined together by two short faces 23, 24 called "lateral faces", which are perpendicular to the long faces. Two other faces 25, 26 are perpendicular to the faces 21 to 24; the face 26, called the "front face", has a cut-out 29 in the shape of an arc of a circle. The front face in its central part has an opening 61 extended by a passage 6 of the same cross-section as the opening 61. The passage 6 is joined to a housing 3 which has an ogive shape; the base of the ogive has a cross-section which is smaller than that of the passage 6 and communicates with it. Owing to this arrangement, there are two cut-aways 62 on either side of the zone linking the housing 3 with the passage 6.

The long face 22 of the chamber 2 has an orifice 8, the function of which will be explained later, situated in line with the housing 3, this orifice being covered by a self-adhesive film cover 9 which may be made of transparent material.

Figure 2:
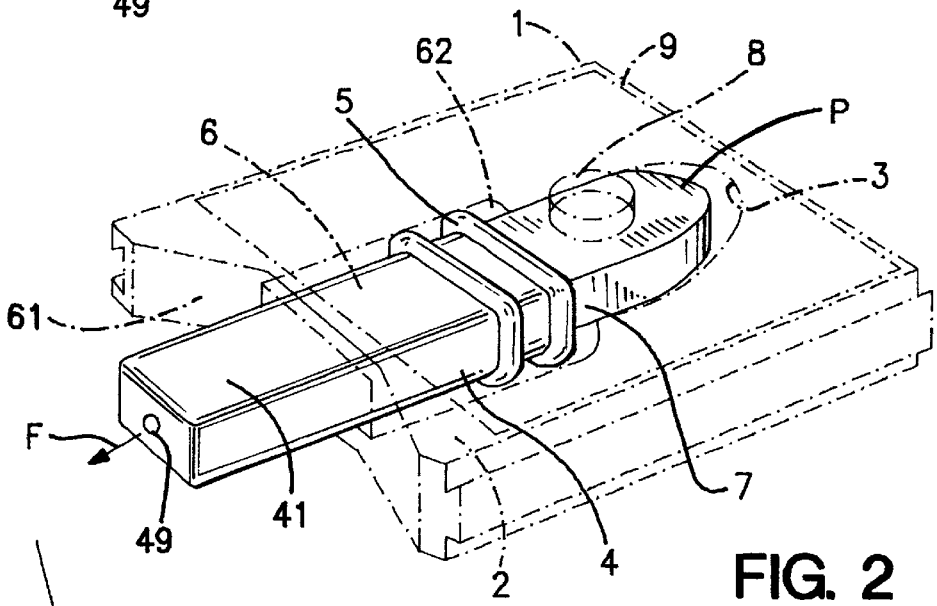
FIG. 2 shows an exploded view of the element of the invention equipped with an applicator showing the arrangement of the applicator in its housing.

As can be seen, especially in FIG. 2, located in the volume formed by the housing 3 and the passage 6 is an applicator 4 having an axis of symmetry A and advantageously made of an elastomeric material, for example of polyethylene or polypropylene or a thermoplastic or elastomeric material such as polyethylene elastomers, polyester, block polyetheramide, polyurethane, nitrile or silicone, etc.

The applicator 4 has a stick 41 of rectangular section, a first free end 42 of which extends slightly beyond the orifice 61, this stick 41 constituting a member for gripping. The applicator 4 includes a central zone 44 equipped with a sealing means 5. This central zone 44 is connected to a second end 43 of the stick 41. The sealing means 5, situated in the central zone 44 consists, for example, of at least one collar 45 having a cross-section slightly larger than that of the passage 6, so that the applicator can be withdrawn from the passage 6 with a slight amount of friction by pulling in the direction of the arrow F (FIG. 2).

The sealing means 5 bears elastically against the cut-aways 62, on the one hand positioning the applicator 4 correctly in the passage 6 and, on the other hand, separating the housing 3 from the passage 6 in a sealed manner.

The central zone 44 on the side opposite the member 41 for gripping is extended by a holding means 7, extending into the housing 3. This holding means 7 consists of a tongue 46, the free end 48 of which is rounded. Formed in its central zone is an orifice 47 positioned substantially facing the orifice 8 and whose function will be explained later. Thus, the free end 48 forms a loop a given distance from the walls of the housing 3.

Furthermore, the applicator 4 has a vent 49 situated substantially in the axis of symmetry A and extending from the free end 42 as far as the orifice 47.

Figure 6:
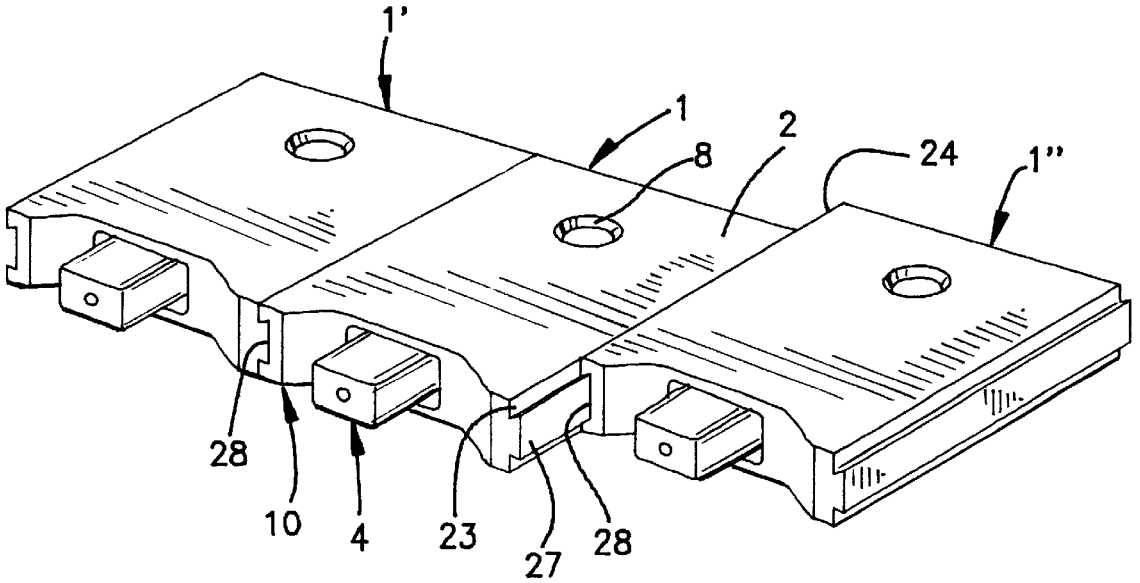
FIG. 6 shows a kit consisting of three elements joined together.

The lateral faces 23, 24 are equipped with an assembly means 10 designed to allow two or more elements 1, 1', 1" to be joined together (FIG. 6). To this end, the face 23 has a longitudinal section piece 27 in the shape of a dovetail, and the face 24 has a groove 28 of a shape which complements that of the section piece 27. Thus it is possible by engaging a section piece of a first element 1 in the groove of a second element 1" to form a set of elements comprising, as appropriate, different products. In this way, a personalized colourway may be assembled.

An element 1 may be manufactured as follows: an applicator 4 made of elastomeric material is located in a chamber 2 obtained, for example, by moulding of a rigid thermoplastic, so that the housing 3 is closed by the sealing collar 45 of the applicator, positioned with the aid of the two cut-aways 62.

Figure 3:
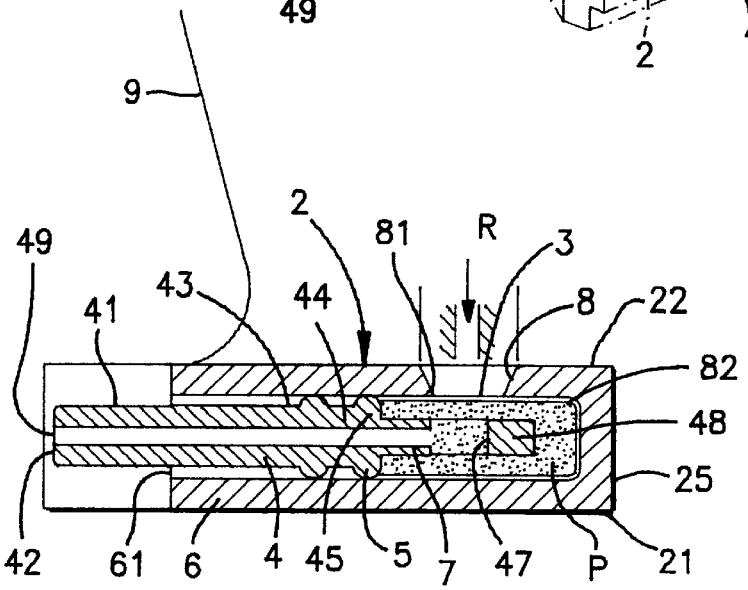
FIG. 3 is a longitudinal section through the element of FIG. 1 showing the element 1 during the phase of filling with product.
Figure 4:
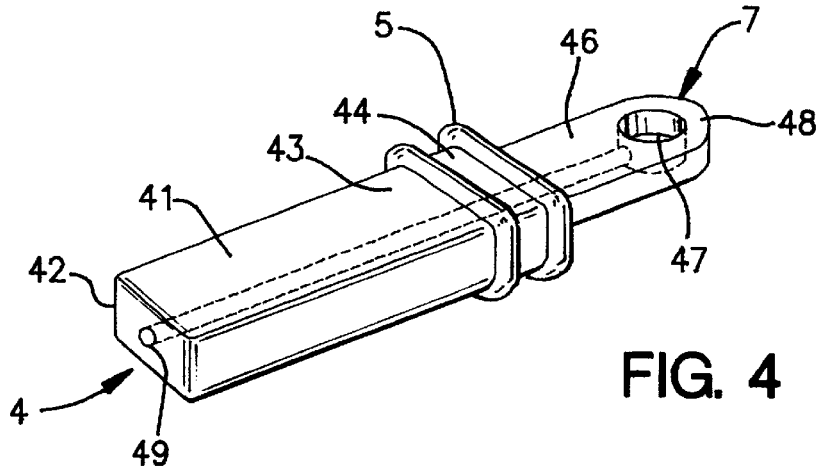
FIG. 4 shows the applicator before being laden with product.
Figure 5:
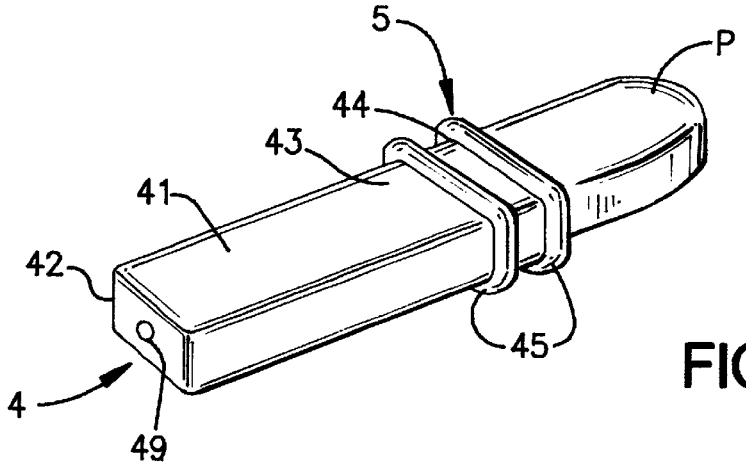
FIG. 5 shows the applicator laden with product.

With reference especially to FIG. 3, a longitudinal section of the element 1 on III—III of FIG. 1 can be seen, showing the chamber 2 equipped with the applicator 4. A filling means R is provided for filling the housing 3 with product P, for example a lipstick composition, in the liquid state, heated to approximately 60° C. to 70° C. beforehand. This filling takes place without the formation of air pockets thanks to the presence of the aforementioned vent 49 via which the air initially contained in the housing 3 may escape.

According to another possibility, the vent may be made in any one of the faces of the chamber 2, for example advantageously in the face 25.

The housing 3, in which the holding tongue 46 extends, is closed by the sealing collar 45. An adequate amount of product P is therefore poured into the housing 3 in the hot state through the filling orifice 8. Thus, the housing 3 serves as a mould for the product which, after cooling, is held on the applicator 4. The orifice 47 of the tongue 46 advantageously situated facing the filling orifice 8, which allows uniform filling of the housing 3. Next, the orifice 8 may be covered by the film cover 9 consisting, for example, of a self-adhesive label which is transparent to allow the colour of the product to show through, or which bears the same colour as the product P.

As can be seen in FIG. 3, the orifice 8 on the housing 3 side is shaped as a circular blade 81 which, as the applicator 4 is taken out of the chamber 2, acts as a tool for scraping off any excess product P and for keeping a smooth surface thereof.

In order to facilitate the release of the product from the mould, the internal walls of the housing 3 may be coated with an agent 82 promoting the release from the mould and/or decreasing the force with which the cooled product adheres to these walls. The mould release agent is, for example, chosen from among silicones, perfluorohydrocarbons, Teflon® (polytetrafluoroethylene), talc and molybdenum disulphide, and material decreasing the adhesion of the product (P) is chosen from among polyacetals, polyethylenes, polypropylenes, polytetrafluoroethylene and silicone rubbers.

In order to apply the make-up, the user takes hold of the chamber 2 in one hand. Next, she grasps the element for gripping between the thumb and index finger of the other hand and pulls in the direction of the arrow F as shown in FIG. 2, and she spreads the product on her lips. The applicator 4 of just one element holds enough lipstick to cover both lips comfortably.

One of the faces of the chamber may be fitted with a mirror, allowing the user to monitor the application of the product during the operation of putting on make-up.

What is claimed is:

1. A cosmetic tester comprising a container having therein a product of generally pasty or solid consistency, and an applicator:

said container being generally a parallelepiped and comprising a housing holding said product and a lengthwise cavity for receiving said applicator, said cavity having an applicator-insertion passageway leading to said housing, said housing comprising a filling-opening for introducing said product into said housing, said filling-opening being separate from said applicator-insertion passage way and having an axis generally perpendicular to an orientation of said applicator-insertion passageway; and said applicator having a portion fitting sealingly into said applicator-insertion passageway to close said housing when said applicator is inserted into said cavity, said portion of said applicator comprising grasping means extending in said housing embedded in said product.

2. The tester of claim 1, further comprising a vent in said applicator for venting air from said cavity to outside said container when said applicator is inserted into said cavity.

3. The tester of claim 2, wherein said vent opens within an indentation in said grasping means end so that said vent is shielded by a portion of said grasping means when said applicator is inserted into said cavity.

4. The tester of claim 3, wherein said filling-opening is in registration with said indentation.

5. The tester of claim 1, wherein said filling-opening has a beveled periphery.

6. The tester of claim 1, further comprising a transparent film cover for closing said filling-opening.

7. The tester of claim 1, wherein said applicator further comprises a handle not within said housing, said applicator-insertion passageway and said handle being generally parallelepipeds.

8. The tester of claim 7, wherein a side of said container to which said applicator-insertion passageway opens comprises a cutoff portion for exposing a portion of said handle.

9. The tester of claim 1, wherein said applicator further comprises a peripheral seal which abuts an interior side of said applicator-insertion passageway when said applicator is inserted into said cavity.

10. The tester of claim 1, further comprising a non-stick coating on an interior surface of said housing.

11. The tester of claim 1, wherein said container is flat so as to be suitable for a promotional insert for a magazine.

12. The tester of claim 1, wherein a side of said container comprises means for mating with another said container.

13. A cosmetic tester comprising a container and an applicator:

said container being generally a parallelepiped having a generally rectangular first face defined by said container's length and width, said container having a thickness substantially less than said length and said width;

a lengthwise cavity in said container for receiving said applicator, said cavity having a rounded closed end, an applicator-insertion passageway leading to said closed end which is larger than said closed end, and a ledge between said closed end and said passageway;

an opening on said first face to said closed end, said opening being narrower adjacent said closed end than adjacent said first face;

said applicator having a handle smaller than said applicator-insertion passageway and a rounded end smaller than said closed end, said handle having a peripheral seal which abuts said ledge to seal said closed end when said applicator is inserted into said cavity, wherein a gap between an exterior of said rounded end and an interior of said closed end is in communication with said opening for receiving a cosmetic, said rounded end having an indentation in a side thereof;

a vent in said applicator for venting air from within said indentation to outside said container when said applicator is inserted into said cavity; and a film cover for closing said opening.

14. The tester of claim 13, wherein said applicator further comprises a second peripheral seal which abuts an interior side of said applicator-insertion passageway when said applicator is inserted into said cavity.

15. A cosmetic tester comprising a container and an applicator:

said container being generally flat and having a first face defined by said container's length and width;

a lengthwise cavity in said container for receiving said applicator, said cavity having a closed end and an applicator-insertion passageway leading to said closed end;

an opening on said first face to said closed end;

said applicator having a handle and an application end which is smaller than said closed end, said handle having a peripheral seal which abuts an interior surface of said cavity to seal said closed end when said applicator is inserted into said cavity, wherein a gap between an exterior of said application end and an interior of said closed end is in communication with said opening for receiving a cosmetic; and a cover for closing said opening.

16. The tester of claim 15, wherein said opening is narrower adjacent said closed end than adjacent said first face.

17. The tester of claim 15, further comprising a vent in said applicator for venting air from within said closed end to outside said container when said applicator is inserted into said cavity.

18. The tester of claim 17, wherein said application end comprises a looped end for shielding said vent when said applicator is inserted into said cavity.

19. The tester of claim 18, wherein said opening is generally coaxial with a hole formed by said looped end.

* * * * *